US005392057A

United States Patent [19]

Lin

[11] Patent Number: 5,392,057

[45] Date of Patent: * Feb. 21, 1995

[54] DISH TYPE ANTENNA

[76] Inventor: Ming T. Lin, No. 3-1, Tapi Lane, Neihsing Li, Nantou City, Natou Hsien, Taiwan, Prov. of China

[ * ] Notice: The portion of the term of this patent subsequent to Aug. 30, 2010 has been disclaimed.

[21] Appl. No.: 36,168

[22] Filed: Mar. 24, 1993

[51] Int. Cl.[6] ..... H01Q 1/12

[52] U.S. Cl. ..... 343/882; 343/840

[58] Field of Search ..... 343/878, 882, 840, 881; 248/183, 185; H01Q 1/12

[56] References Cited

U.S. PATENT DOCUMENTS 3,714,660 1/1973 Scrafford et al. ..... 343/882
4,086,599 4/1978 VanderLinden, Jr. et al. .... 343/882
4,652,890 3/1987 Crean ..... 343/840
4,783,662 11/1988 Wirth, Jr. et al. ..... 343/882
4,804,971 2/1989 Bruns et al. ..... 343/882
5,198,830 3/1993 Lin ..... 343/882

*Primary Examiner*—Donald Hajec
*Assistant Examiner*—Tan Ho
*Attorney, Agent, or Firm*—Bacon & Thomas

[57] ABSTRACT

A dish type antenna includes a board fixed to the back surface of a dish, a frame having a lower portion fixed to a base and an upper portion pivotally coupled to the board at a pivot axle, and a cylinder pivotally coupled between the base and the board so as to rotate the dish about the pivot axle. The antenna includes a simplified configuration and can be easily disengaged and removed.

1 Claim, 4 Drawing Sheets

DISH TYPE ANTENNA

BACKGROUND OF THE INVENTION

1. Field of the Invention

The present invention relates to an antenna, and more particularly to a dish type antenna.

2. Description of the Prior Art

Two typical dish type antennas are disclosed in U.S. Pat. No. 4,652,890 to Crean, filed Jul. 24, 1984, and U.S. Pat. No. 4,804,971 to Bruns et al., filed Apr. 16, 1986. Both of the antennas include a post mounted within ground by being embedded in a poured concrete base or support, such that the antennas can not be easily removed when required, for example, when hurricane comes. In addition, both of the antennas include a complicated configuration, which is adverse for both manufacturing and assembling purposes.

The present invention has arisen to mitigate and/or obviate the afore-described disadvantages of the conventional dish type antenna.

SUMMARY OF THE INVENTION

The primary objective of the present invention is to provide a dish type antenna which includes a simplified configuration and which can be easily disengaged and removed.

In accordance with one aspect of the invention, there is provided a dish type antenna comprising a dish including a back surface, a board fixed to the back surface of the dish, a base, a frame including a lower portion fixed to the base and an upper portion pivotally coupled to the board at a pivot axle, and a cylinder including a lower end pivotally coupled to the base and an upper end pivotally coupled to the board so as to rotate the dish about the pivot axle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
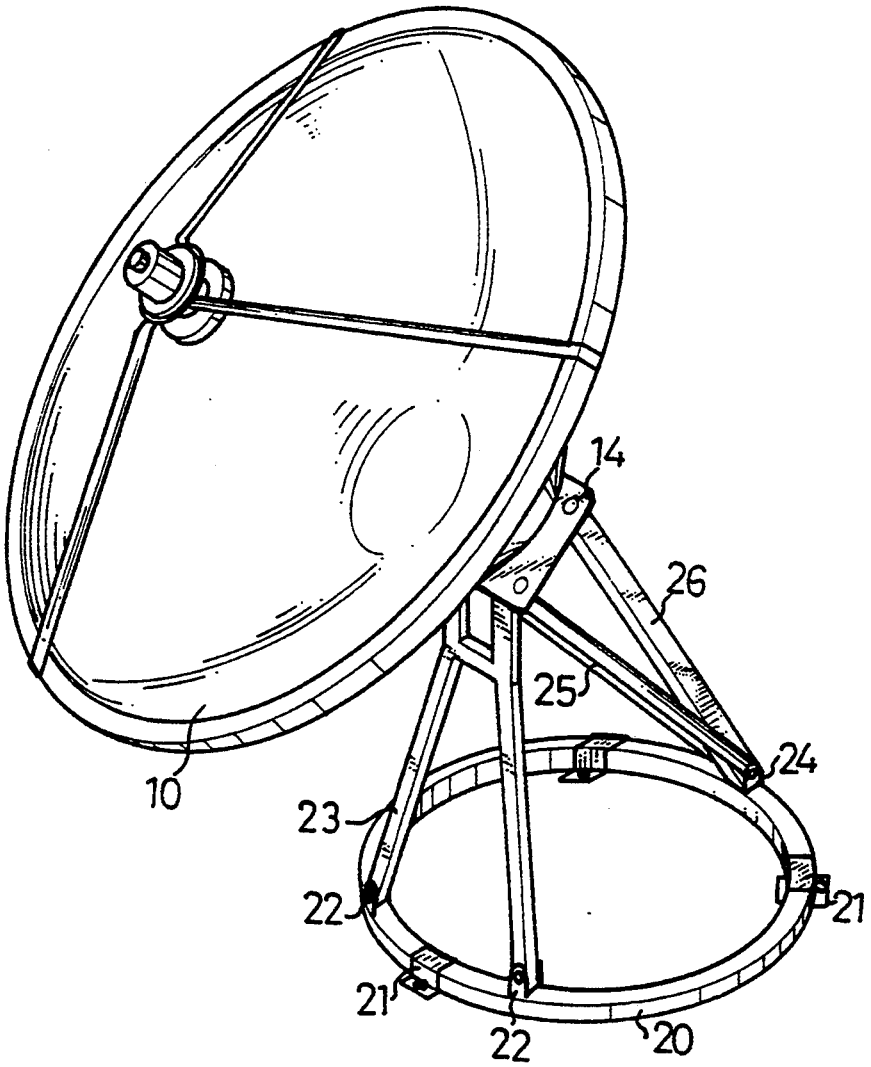
FIG. 1 is a perspective view of a dish type antenna in accordance with the present invention.
Figure 2:
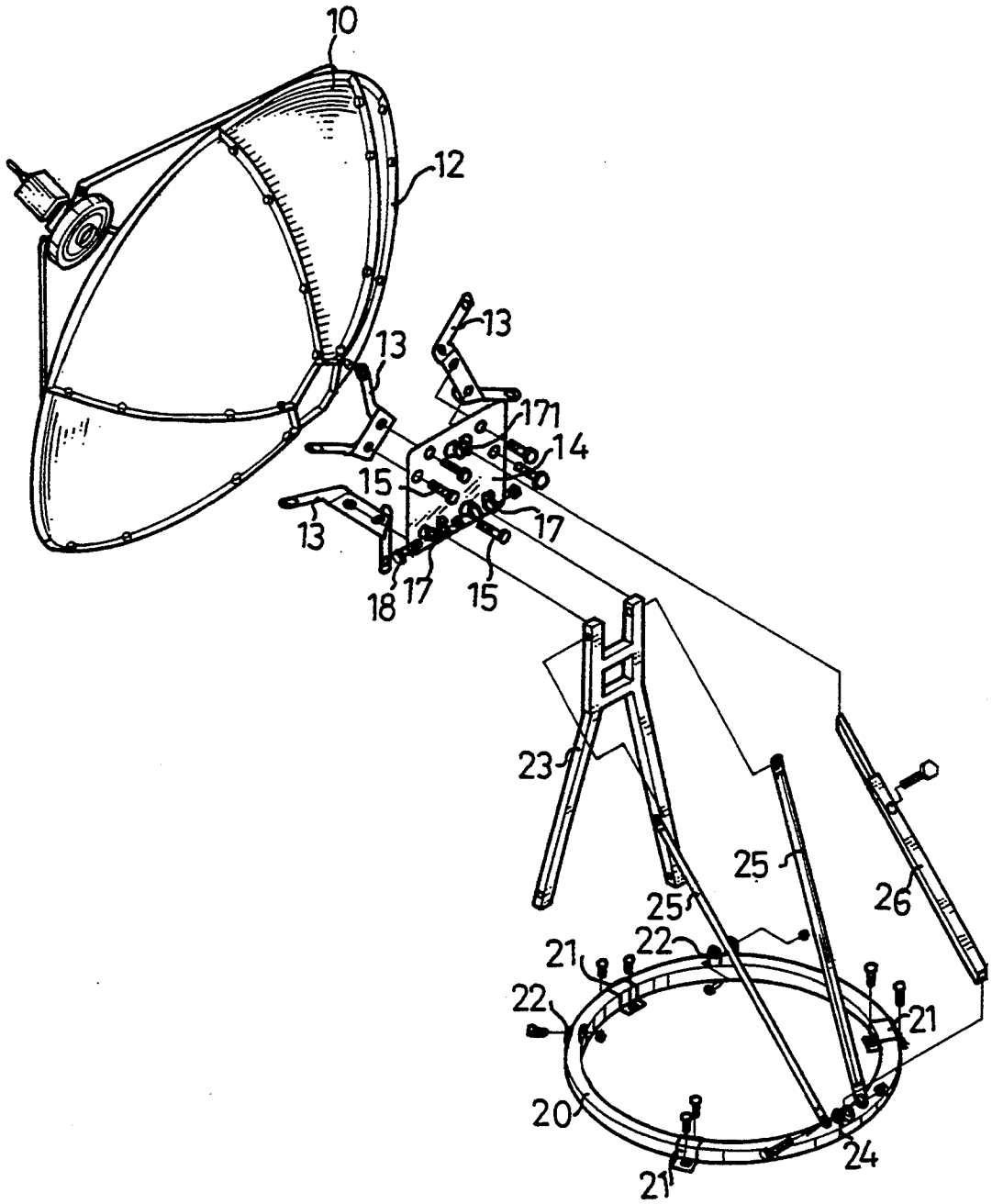
FIG. 2 is an exploded view of the antenna.
Figure 3:
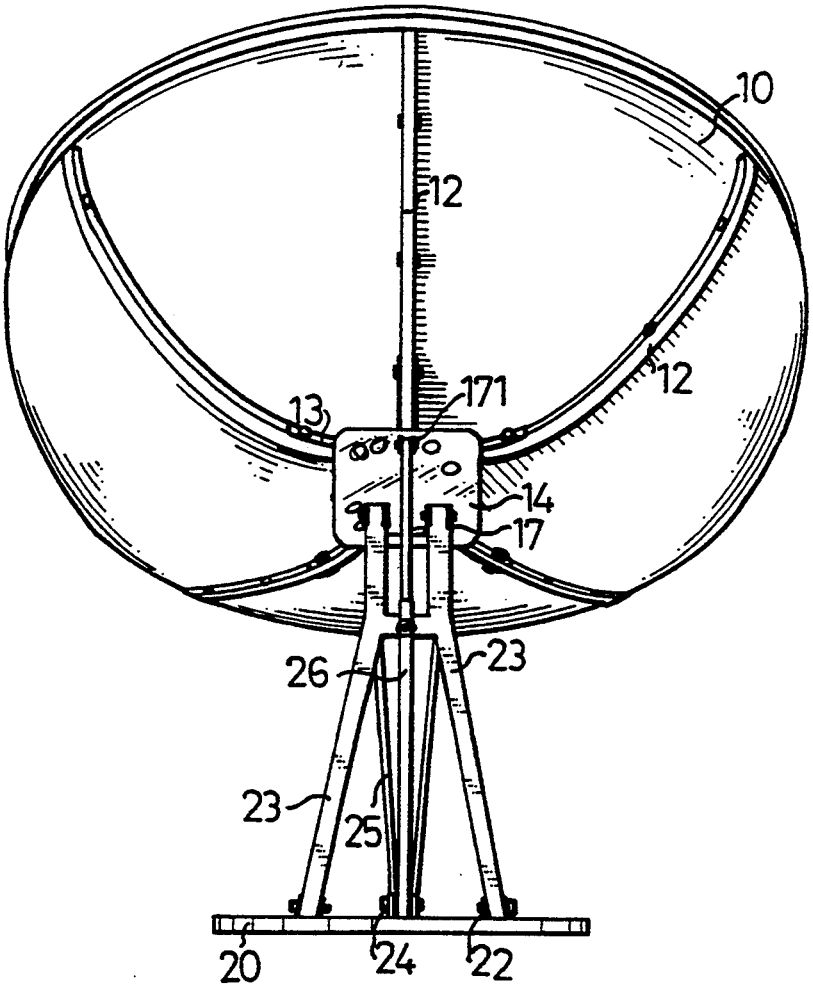
FIG. 3 is a rear view of the antenna.

Referring to the drawings, and initially to FIGS. 1 to 3, a dish type antenna in accordance with the present invention comprises a dish 10 including a plurality of bracing ribs 12 extended radially outward along the back surface of the dish from approximately the vertex of the paraboloid, a plurality of brackets 13 fixed to the ribs 12, a board 14 fixed to the brackets 13 by bolts 15 and including two pairs of lugs 17 and a pair of ears 171 formed therein.

A base 20 which is preferably circular includes two pairs of lugs 22 and a pair of ears 24 extended upward therefrom, the base 20 can be fixed on the supporting surface, such as the ground by fixing members 21. A frame 23 includes a lower portion pivotally coupled to the base 20 at the lugs 22 and an upper portion pivotally coupled to the board 14 at the lugs 17 by bolts 18 and arranged such that the dish 10 is rotatable about the pivot axle formed by the bolts 18. A pair of levers 25 include an upper end fixed to the upper portion of the frame 23 by the bolts 18 and a lower end fixed to the ears 24, and a cylinder 26 having a lower end pivotally coupled between the ears 24 and an upper end pivotally coupled between the ears 171 of the board 14, such that the board 14 and thus the dish 10 can be caused to rotate about the pivot axle formed by the bolts 18 when the cylinder 26 is actuated.

Figure 4:
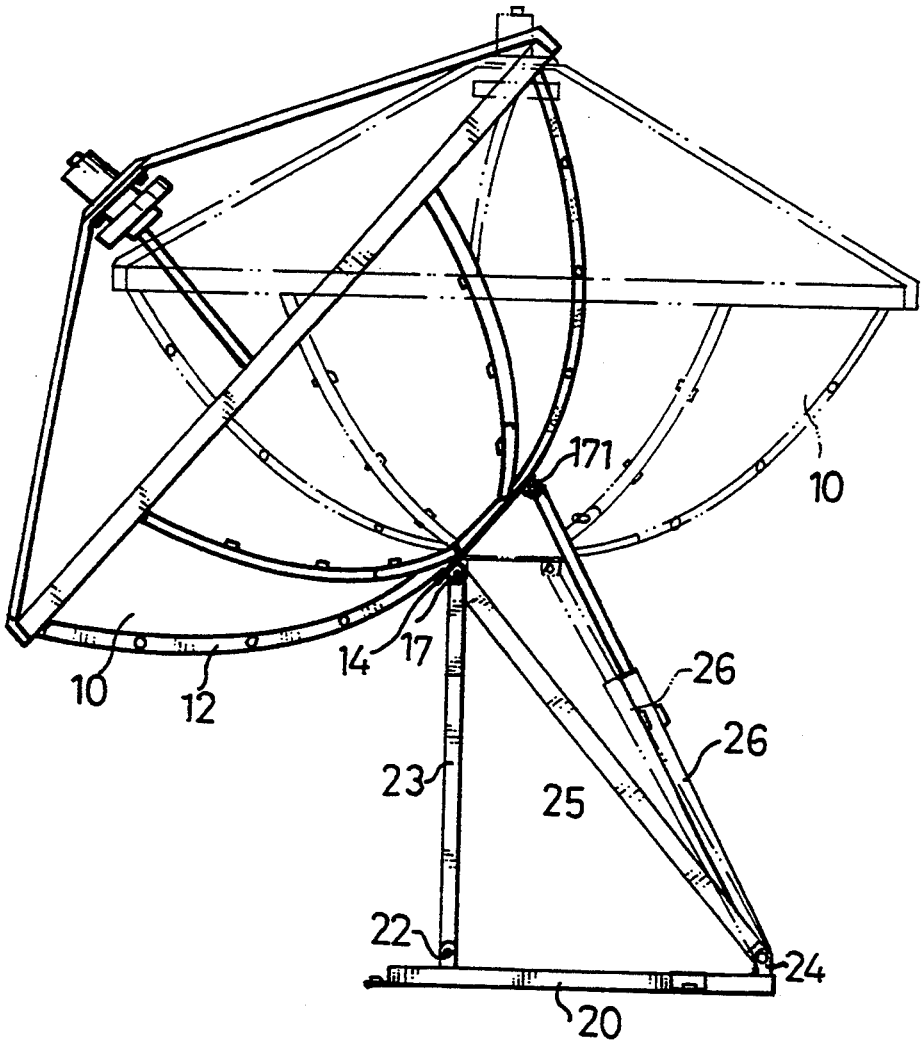
FIG. 4 is a side view illustrating the operation of the dish type antenna.

Referring next to FIG. 4, in operation, the cylinder 26 is actuated in order to rotate the dish 10 about the pivot axle formed by the bolts 18.

Accordingly, the dish type antenna in accordance with the present invention includes a simplified configuration, in addition, the dish antenna can be easily disengaged and removed, particularly when hurricane comes, Although this invention has been described with a certain degree of particularity., it is to be understood that the present disclosure has been made by way of example only and that numerous changes in the detailed construction and the combination and arrangement of parts may be resorted to without departing from the spirit and scope of the invention as hereinafter claimed.

I claim:

1. A dish type antenna comprising a dish including a back surface, a plurality of ribs extended radially on said back surface of said dish, a plurality of brackets fixed to said ribs of said dish, a board fixed to said brackets and including a pair of first ears formed thereon, a base including a pair of second ears extended upward therefrom, a frame including a lower portion fixed to said base and an upper portion pivotally coupled to said board at a pivot axle, at least one lever coupled between said upper portion of said frame and said second ears of said base, and a cylinder including a lower end pivotally coupled to said second ears of said base and an upper end pivotally coupled to said first ears of said board so as to rotate said dish about said pivot axle.

* * * * *